US006228215B1

(12) United States Patent
Hoffman, Jr.

(10) Patent No.: US 6,228,215 B1
(45) Date of Patent: May 8, 2001

(54) METHOD FOR COUNTERCURRENT TREATMENT OF SLURRIES

(75) Inventor: Roger P. Hoffman, Jr., Green Bay, WI (US)

(73) Assignee: Hoffman Enviornmental Systems, Inc., Green Bay, WI (US)

( * ) Notice: Subject to any disclaimer, the term of this patent is extended or adjusted under 35 U.S.C. 154(b) by 0 days.

(21) Appl. No.: 09/055,847

(22) Filed: Apr. 6, 1998

(51) Int. Cl.[7] ..... D21C 9/02

(52) U.S. Cl. ..... 162/60; 162/204; 68/44; 210/783; 210/928

(58) Field of Search ..... 162/60, 4, 204, 162/205; 210/783, 786, 928; 68/44, 205 R, 158, 148

(56) References Cited

U.S. PATENT DOCUMENTS

| | | | | |
|---|---|---|---|---|
| 3,906,853 | | 9/1975 | Wohlfarter | 100/118 |
| 4,113,556 | | 9/1978 | Kankaapää | 162/272 |
| 4,501,040 | | 2/1985 | Biondetti et al. | 8/156 |
| 4,664,749 | | 5/1987 | Haapamäki et al. | 162/56 |
| 4,680,088 | | 7/1987 | Bastanzuri | 162/54 |
| 4,938,038 | | 7/1990 | Sbaschnigg et al. | 68/9 |
| 5,013,460 | | 5/1991 | Meredith | 210/770 |
| 5,045,181 | | 9/1991 | North | 209/10 |
| 5,114,536 | | 5/1992 | Kangas | 162/55 |
| 5,122,229 | | 6/1992 | Seifert | 162/60 |
| 5,196,090 | * | 3/1993 | Corebellini et al. | 162/190 |
| 5,204,009 | | 4/1993 | Rowland | 210/772 |
| 5,368,693 | * | 11/1994 | Vikio | 162/190 |
| 5,558,782 | * | 9/1996 | Bleakley et al. | 210/712 |
| 5,741,398 | * | 4/1998 | Germgard et al. | 162/37 |
| 5,753,074 | | 5/1998 | Hoffman | 162/4 |
| 5,846,378 | * | 12/1998 | Phipps | 162/29 |

FOREIGN PATENT DOCUMENTS

| | | |
|---|---|---|
| 2043840 | 12/1991 | (CA) . |
| 197608 | 8/1976 | (JP) . |
| WO 86/03795 | 7/1986 | (WO) . |

* cited by examiner

*Primary Examiner*—Dean T. Nguyen
(74) *Attorney, Agent, or Firm*—Weiss & Weiss PC; Philip M. Weiss

(57) ABSTRACT

An aqueous slurry containing dissolved solids and a high concentration of suspended solids is positioned as a mat between a pair of porous endless belts to provide a composite structure. The composite structure is moved through a treating zone and subjected to alternate stages of compression and relaxation. In a preferred mode, the compression and relaxation are achieved by passing the composite structure over a series of spaced rolls in a manner such that a first belt of the pair is in direct contact with one of the rolls and a second belt of the pair is in contact with the next adjacent roll. A liquid stream containing a high concentration of dissolved solids is cascaded over the mat in a countercurrent fashion, with the result that dissolved solids of the liquid stream are dissolved in the aqueous phase of the mat when the mat is subject to relaxation. The mat containing the increased concentration of dissolved solids and suspended solids can then be compacted and the solid residue can be landfilled. The liquid stream being discharged from the treating zone and containing a depleted concentration of dissolved solids can then be recirculated for use in a papermaking or pulp processing operation.

9 Claims, 2 Drawing Sheets

METHOD FOR COUNTERCURRENT TREATMENT OF SLURRIES

BACKGROUND OF THE INVENTION

In a conventional papermaking operation, wood chips are subjected to severe conditions of acidity or alkalinity at high temperatures in a pulping operation in order to dissolve the more soluble lignin, but not the less soluble cellulosic fibers. After pulping, the cellulosic pulp is subjected to a cleaning operation to remove suspended solids or particulate material. In a typical cleaning operation, debris and heavy material, such as stones, metal, glass, and the like, are initially removed from the pulp by a centrifugal cleaner and the pulp is then subject to coarse screening followed by secondary finer screening to remove large and small sized contaminants. Following this, the pulp is subjected to a forward cleaning operation to remove sand, small fiber bundles, ink and the like, followed by reverse cleaning to remove lighter materials, such as wax, latex, hot melt, and other materials. Following the cleaning the pulp undergoes a washing operation which acts to remove dissolved organic and soluble inorganic material present in the pulp mass. It is necessary to remove dissolved solids because the dissolved solids interfere with bleaching and with the papermaking operation. Further, dissolved solids are a source of increased biological oxygen demand, chemical oxygen demand and color when the dissolved solids are discharged into an effluent system.

After washing, the pulp undergoes stock preparation and the refined and diluted pulp is then utilized in the papermaking machine to produce a paper sheet in the conventional manner.

A common method of washing pulp is a countercurrent system in which fresh wash water is added to the pulp in the final stage of washing and the wash water is then recycled in an upstream direction toward the first stage of the washing operation. With the countercurrent system, the dissolved solids concentration of the wash water increases as it moves from the final stage to the first stage, while the concentration of dissolved solids in the pulp decreases as it travels from the first stage to the final stage.

United States patent application Ser. No. 08/697,271, filed Aug. 21, 1996, now U.S. Pat. No. 5,753,074 describes an improved pulp washing process in which a thin mat of pulp slurry is positioned between a pair of porous endless fabrics or belts to provide a composite structure. The composite structure is then moved upwardly through a washing zone over a series of vertically spaced rolls in a generally sinuous path of travel, such that a first of the belts is in direct contact with one roll, and the second belt is in direct contact with an adjacent roll. As the pulp mat travels through the washing zone, wash water is directed against the mat at the upper end of the washing zone and is cascaded downwardly through the washing zone by a series of baffles. As the pulp mat travels between adjacent rolls, the mat is impregnated with wash water and as the composite structure travels around the rolls, the tension in the belts increases, creating a dewatering action, so that the pulp mat is alternately showered with water and then dewatered by the belt tension.

Thus, the washing process as described in the aforementioned patent removes dissolved solids, as well as suspended fillers, while utilizing a minimum quantity of water, as compared with conventional countercurrent pulp washing operations.

SUMMARY OF THE INVENTION

The invention is directed to an improved method and apparatus for the countercurrent treating of slurries or sludges and has particular application to the treatment of residual slurries from a papermaking operation In every papermaking process there is a need to purge the system of contaminants or undesirable materials. Typically, a pulp cleaning operation produces undesirable materials that fall into two categories: the first being a sludge or slurry containing a high concentration of suspended solid contaminants and the second being a liquid stream containing a minor portion of suspended solids and assortment of colloidal and dissolved solids.

In accordance with one aspect of the invention, the sludge or slurry containing the high concentration of solid contaminants is positioned between a pair of porous endless belts as a sludge mat, to provide a composite structure. The composite structure, consisting of the pair of belts with the intermediate sludge mat, is moved through a treating zone where the mat is subjected to alternate stages of compression and relaxation. In a preferred form of the invention, the compression stages are achieved by passing the composite structure over a series of spaced rolls in a generally sinuous path of travel.

The residual liquid stream from the pulp cleaning operation is concentrated to increase the concentration of dissolved solids and the concentrated stream is then cascaded over the sludge mat in a countercurrent fashion as the composite structure passes through the treating zone, causing the liquid stream to impregnate the mat when the mat is subjected to relaxation as it moves between adjacent rolls. This results in the dissolved solids in the highly concentrated liquid stream being dissolved into the aqueous phase of the sludge mat, to thereby reduce the concentration of dissolved solids in the liquid stream and correspondingly increase the proportion of dissolved solids in the sludge mat. In addition, suspended solids in the liquid stream are entrapped in the sludge mat.

As a result of the process of the invention, the concentration of dissolved solids in the liquid stream is substantially reduced, so that the liquid stream being discharged from the treating zone can be recycled in the pulp processing or paper-making operation. The sludge mat having the increased concentration of dissolved solids and suspended solids, can the compacted and the resulting solid residue can either be landfilled or incinerated.

The process of the invention has particular application for use in a zero liquid discharge papermaking operation, in that it eliminates the discharge of liquid having a high concentration of dissolved solids to the environment.

In a modified form of the invention, a cellulosic pulp slurry is positioned between a pair of porous endless belts as a mat to provide a composite structure, and the composite structure, including the pulp mat, is moved through a treating zone rolls where the mat is subjected to alternate stages of compression and relaxation.

A liquid stream containing a material, such as dye or bleach, which will react with the cellulosic fibers of the pulp is passed countercurrently through the treating zone and impregnates the pulp mat, when the mat is subjected to relaxation causing the reactive material to react with the cellulosic fibers. The pulp mat leaving the downstream end of the washing zone is then compacted to remove excess liquid. This process provides a convenient and efficient method of reacting a reactive substance with suspended particulate material in a slurry.

In a further modified form of the invention, a sludge or slurry containing a high concentration of suspended solids is positioned between a pair of endless porous belts as a thin mat to provide a composite structure. As in the case of the prior embodiments, the composite structure is moved through a treating zone and subjected to alternate stages of compression and relaxation, as for example by moving the composite structure in a generally sinuous path over a plurality of spaced rolls. A liquid stream containing suspended solids is directed against the composite structure at locations between adjacent rolls and the liquid is cascaded over the structure in a countercurrent manner, causing the suspended solids in the liquid stream to be entrapped in the mat. As a result of the process, the concentration of suspended solids in the liquid stream is reduced, while the concentration of suspended solids in the mat is correspondingly increased.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Most papermaking operations discharge tremendous quantities of liquid which contain suspended solids, such as wood fibers and bark, clay, calcium carbonate, fine stickies, and inks from processing of recycled fibers, and sand, along with oxygen demanding organic compounds, such as starches, lignins, and hemicellulose. In addition, the liquid discharge can also contain trace chemicals, such as chlorinated organic compounds and metals such as barium, aluminum and other trace elements. The adverse environmental impact of this liquid discharge from a papermaking operation is well documented.

In a typical pulp cleaning operation, debris and heavy material, such as stones, metal, glass, and the like are initially removed from the pulp by a centrifugal cleaner and the pulp is then subjected to coarse screening followed by secondary finer screening to remove large and small size contaminants. Following this, the pulp is subjected to a forward cleaning operation utilizing a centrifugal cleaner to remove sand, small fiber bundles, ink and the like, and in the case of recycled fibers, is then subjected to reverse cleaning, in which lighter materials such as wax, latex hot melts, are separated. Typically the most highly contaminated water discharged from a conventional papermaking operation results from the pulp cleaning operation. As a result of the conventional cleaning, two residual discharge streams are produced, the first consisting of an aqueous phase containing the vast majority of the solid contaminants, such as fine fibers, sand, bark, fillers, waxes, dirt and stickies, collectively called sludges, and a second liquid stream that contains only a small concentration of fine fiber debris but also contains various colloidal and dissolved solids, including starch, alum, polymers used in papermaking as retention aids and fluctuants, residual spent pulping chemicals and lignin not removed in washing, as well as microcontaminants from recycled fibers, and other impurities so small so as to elude the cleaning process.

Figure 1:
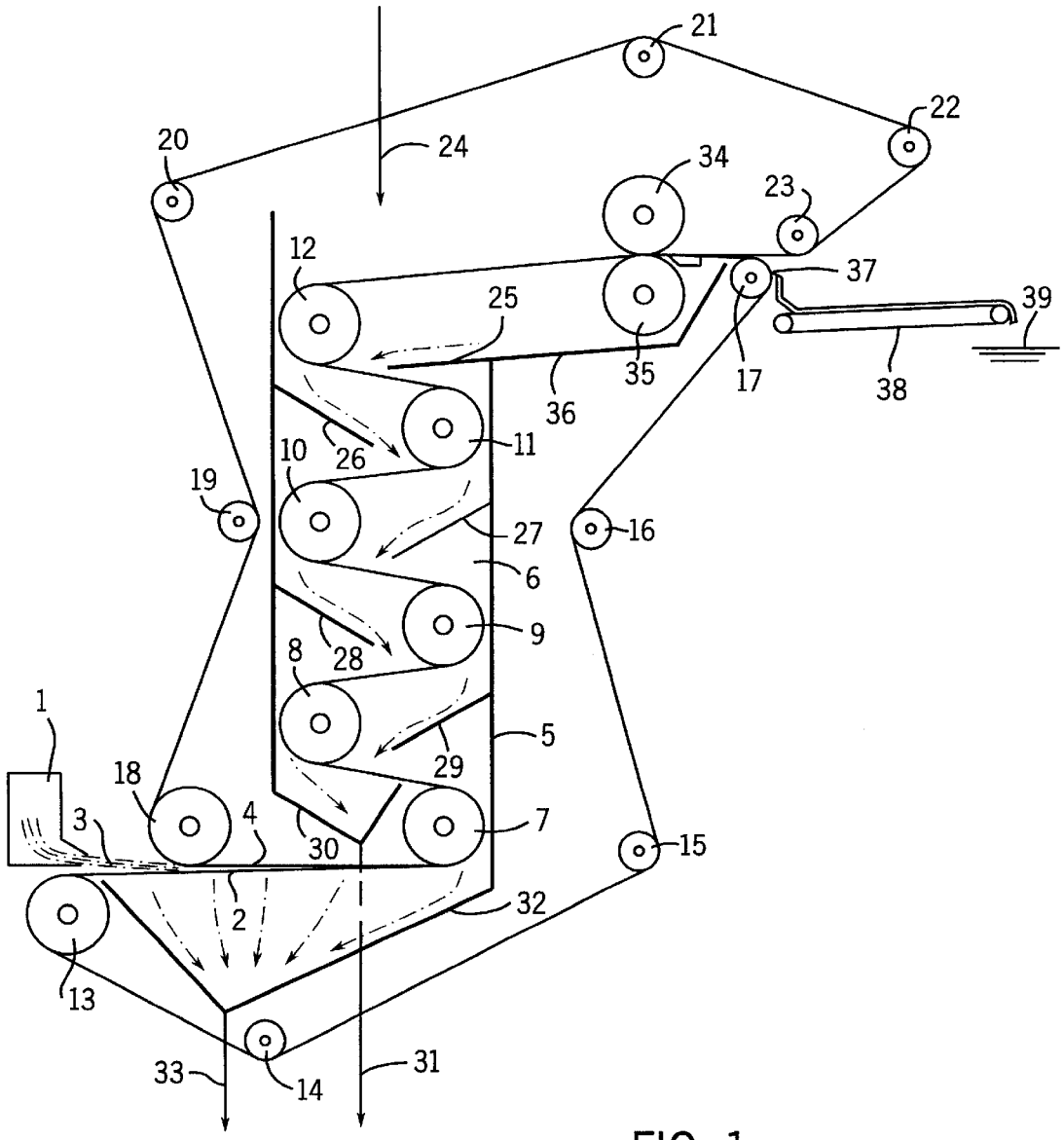
FIG. 1 is a schematic representation of the apparatus to be used to carry out the method of the invention.

In a preferred method, as shown in FIG. 1, the first residual stream or slurry containing a high concentration of suspended solids and having a solids content of about 2% by weight, is fed from a headbox 1 onto an endless porous belt or screen 2 in the form of a sludge mat 3 having a basis weight generally of about 10 to 300 lbs. of dry sludge per 1,000 sq. ft. In practice, belt 2 may have a mesh size of about 25 to 70.

A second endless porous belt 4 having a mesh size similar to belt 2 is positioned on top of mat 3., thus sandwiching mat 3 between belts 2 and 4, and providing a composite structure.

The composite structure, consisting of belts 2 and 4 and the sludge mat 3, then enters the lower end of the vessel or tank 5, which defines a treating zone 6. Journaled for rotation within vessel 5 is a series of rolls 7–12. Rolls 7 and 8 can be drive rolls, while rolls 9–12 can be idler rolls. As belt 2 is in direct contact with roll 8, and belt 4 is in direct contact with roll 7, both belts will be connected to the drive mechanism for synchronization. The drive for rolls 7 and 8 can be any conventional electric or hydraulic drive system which will drive the belts generally in the range of 10 to 1,000 feet per minute.

Belt 2 is trained over a series of rolls 13–17 which are located outside of vessel 5 and similarly belt 4 is trained over a series of rolls 18–23 which are likewise located outside of the vessel 5.

The second liquid stream from the pulp cleaning operation is initially concentrated to increase the concentration of dissolved solids to a value greater than the concentration of dissolved solids in sludge mat 3 and preferably in the range of about 2% to 40% by weight solids. The concentration of the second stream can be carried out by a process such as evaporation, reverse osmosis or ultrafiltration. The concentrated stream is then introduced into the upper or downstream end of treating zone 6 through an inlet 24. The liquid stream entering through inlet 24 impinges against the composite structure to thereby impregnate the sludge mat 3 with the liquid. Vessel 5 contains a series of inclined baffles 25–29 which direct the liquid downwardly through the washing zone 6 in a countercurrent cascading type of flow. The liquid flowing from the lowermost baffle 29 will pass in contact with the portion of the sludge mat 3 traveling from roll 7 to 8, and the liquid passing through this portion of the mat will be collected in trough 30 and discharged through line 31.

In addition, liquid being extracted from the sludge mat 3 as the composite structure approaches roll 7 will be collected in bottom trough 32 and can be discharged through outlet line 33.

With the construction shown in FIG. 1, the baffles 25–29 direct the treating liquid downwardly to the next stage in a countercurrent fashion. The liquid being drained from each baffle contacts the mat 3 at a location between adjacent rolls, so that the liquid will impregnate the mat. As the composite structure, consisting of the pair of belts 2 and 4 with the intermediate mat 3, passes around the next roll, the pressing action of the outside belt, forces the liquid out of the mat as the mat moves around the roll. The mat is subjected to alternate relaxation as it moves between rolls and compression as it passes around the rolls, thus enabling the treating liquid to impregnate the mat when the mat is subject to relaxation and causing the impregnated liquid to be extracted or discharged from the mat as the mat is subject to compression.

Located at the upper or downstream end of the vessel 5 is a pair of press rolls 34 and 35. As the composite structure passes between press rolls 34 and 35, liquid will be extracted from the mat 3 and collected in trough 36. The bottom of trough 36 comprises an extension to baffle 25, so that the extracted liquid will flow down the bottom of trough 35 and across baffle 25 to impregnate the portion of the mat which is traveling between rolls 11 and 12.

In practice, the press rolls 34 and 35 will compact the mat to a solids content generally in the range of about 30% to 50%, and the compacted mat is then removed from belt 2 by a conventional doctor blade 37 and is delivered to a conveyor 38 which conveys the mat to a disposal site 39. At this moisture content, the mat can either be landfilled or incinerated.

As the concentrated liquid stream entering vessel 5 through inlet 24 has a substantially greater concentration of dissolved solids than the aqueous phase of mat 3, dissolved solids from the liquid stream will be diffused or transferred to the aqueous phase of the mat 3 as the liquid stream moves countercurrently through the washing zone, with the result that an equilibrium is approached in which the concentration of dissolved solids in the mat leaving the washing zone will approximate the concentration of dissolved solids in the liquid stream exiting the washing zone. In addition, any residual suspended fines in the concentrated liquid stream will be entrapped in the fibrous material of mat 3.

The invention, as shown in FIG. 1 can be used in a papermaking operation to prevent the gradual buildup of dissolved solids in the water phase by transferring a substantial portion of the dissolved solids from the concentrated liquid stream to the sludge mat, which can then be compacted and landfilled. The liquid stream discharged from the washing zone 6 and containing a substantially reduced concentration of dissolved solids can then be recirculated and used in the papermaking operation. Thus, the invention provides a convenient and effective method of eliminating liquid discharge from a papermaking operation.

Figure 2:
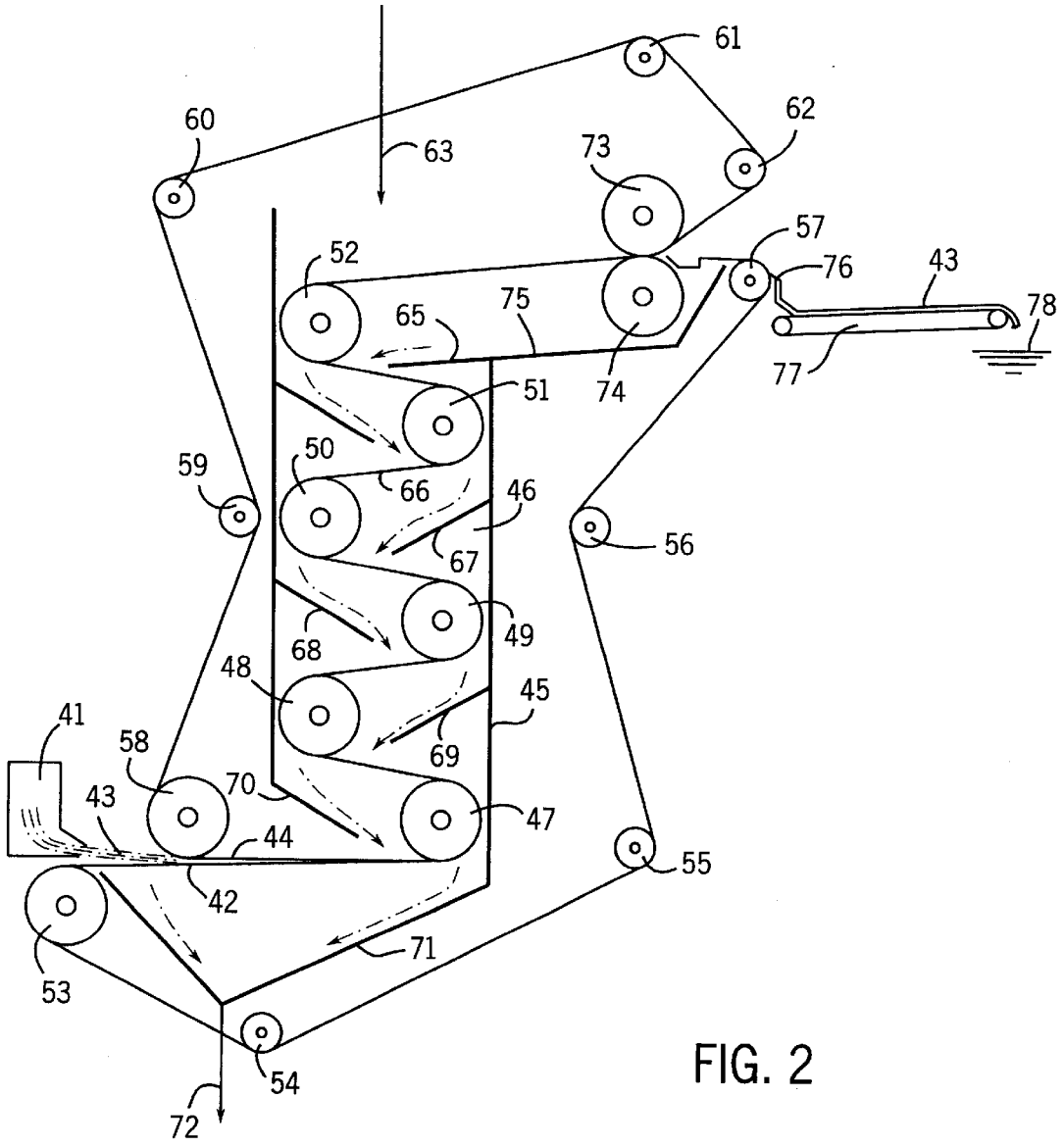
FIG. 2 is a schematic representation of an apparatus used to carry out a modified form of the invention.

FIG. 2. shows a modified form of the invention, in which a slurry is treated with a reactive material and has particular application to the treatment of a cellulosic pulp slurry with a material, such as a dye or bleach, which is capable of reacting with the cellulosic fiber material.

The washing or treating apparatus of FIG. 2 is similar to that described with respect to FIG. 1. More specifically, the slurry at a consistency of about 2% solids and containing a suspended material, such as cellulosic fibers, is discharged from headbox 41 onto an endless, porous belt 42 in the form of a thin pulp mat 43. As described with respect to the first embodiment, mat 43 is sandwiched between belt 42 and a second endless porous belt 44 to provide a composite structure which is moved upwardly through a vessel 45 that defines a washing or treating zone 46.

The composite structure, consisting of belts 42 and 44 with the intermediate mat 43, passes in a sinuous path around rolls 47–52, which are similar in construction and operation to rolls 7–12 of the first embodiment, Belt 42 is trained over a series of rolls 53–57 which are located outside of the washing zone, and similarly belt 44 is trained over a group of rolls 58–62 which are likewise located outside of washing zone 46.

A liquid, such as water, containing a material which is capable of reacting with the suspended material in mat 43 is introduced into the upper end of the vessel 45 through inlet line 63. When dealing with a cellulosic pulp slurry, the reactive material can be a dye or bleach.

Positioned within vessel 5 are inclined baffles 65–69 which are similar in operation and construction to baffles 25–29 of the first embodiment. The liquid entering the vessel through inlet 64 thus cascades downwardly along the baffles to the bottom of the vessel. Each baffle 65–69 terminates between a pair of adjacent rolls, so that the liquid flowing from each baffle will contact the composite structure at a location between adjacent rolls to thereby impregnate the mat and cause the reactive material to react with the suspended material or pulp. As previously described, the liquid will be squeezed from the mat as the mat passes over the rolls, so that the mat is subjected to alternate relaxation and compression and the liquid stream is impregnated into the mat while the mat is subjected to relaxation. The liquid passing through the mat 43 at the lower end of washing zone 46 flows across the inclined lower surface 70 of vessel 45, then impregnates the portion of mat 43 traveling to roll 47 and is collected in trough 71. The liquid, depleted of the reactive material, can be discharged from trough 71 through line 72.

The invention thus provides an efficient method of effecting a reaction between a reactive material and a solid particulate component.

Located at the upper end of the washing zone 6 is a pair of press rolls 73 and 74 similar to rolls 34 and 35 of the first embodiment. Rolls 73 and 74 act to compact mat 43 extracting liquid from the mat and the extracted liquid is discharged into an inclined trough 75 which forms an extension to the upper baffle 65. The compacted mat 43 can be removed from belt 42 by a conventional doctor blade 76 and the mat is delivered to an end of a conveyor 7 which conveys the mat to a suitable collection site 78.

While the above descriptions show the rolls 7–12 and 47–52 located in a generally vertical arrangement, it is contemplated that the rolls can be located in a horizontal arrangement, but in this case pumping equipment would be required to convey the liquid from one stage to the next. Using the vertical arrangement of rolls as shown in FIGS. 1 and 2, enables the liquid to cascade downwardly by gravity, thus eliminating the need for pumping equipment.

In a further modified form of the invention, the process as shown in FIG. 2 can be used to transfer suspended or colloidal material from a liquid stream to a mat of suspended or particulate material., In this regard, a sludge or slurry having a high concentration of suspended solids is used as mat 43 and is positioned between belts 42 and 44. A liquid stream, containing suspended or colloidal material is fed to washing zone 46 through inlet 64 and the liquid is cascaded over the mat in a countercurrent manner, as previously described, causing the suspended or colloidal material in the liquid stream to be entrapped in the mat. As a result, the concentration of suspended or colloidal material in the liquid stream, is reduced, while the concentration of this material in the mat is correspondingly increased. In the papermaking field, this embodiment has particular application in impregnating a cellulosic pulp slurry with starch.

While the above embodiments have shown the sludge mat being subject to alternate compression and relaxation by passing the mat over a series of spaced rolls in a generally sinuous path of travel, it is also contemplated that the alternate compression and relaxation can be achieved by passing the mat, sandwiched between a pair of porous belts, over a series of spaced vacuum boxes and contacting the mat with a liquid stream at locations between adjacent vacuum boxes. As the mat passes over each vacuum box it would be subjected to compression to extract liquid and as it passes between vacuum boxes the mat would be in a state of relaxation to enable the liquid to impregnate the mat. Again, the liquid would be moved countercurrently through the treating zone by suitable pumping equipment.

I claim:

1. A method of treating a liquid slurry comprising the steps of positioning a mat having a liquid phase and containing material selected from the group consisting of dissolved solids, suspended solids and mixtures thereof comprising solid contaminants between a pair of porous endless belts to provide a composite structure, moving the composite structure through a treating zone and subjecting the mat to alternate stages of compression and relaxation, passing a liquid stream containing a substance selected from the group consisting of dissolved solids, suspended solids, and mixtures thereof comprising solid contaminants through the treating zone countercurrently to the direction of movement of said composite structure through said zone, to cause said liquid stream to impregnate the mat when the mat is subjected to relaxation and transfer said substance to the liquid phase of the mat, and removing the mat from said belts.

2. The method of claim 1, and including the step of compacting the mat after the mat travels through said treating zone to provide a solid residue and a liquid residue.

3. The method of claim 1, and recovering the second stream having a reduced dissolved solids content from the washing zone, and utilizing the recovered second stream in the papermaking process.

4. A method of treating a liquid slurry, comprising the steps of positioning a mat of a liquid slurry having a liquid phase and containing dissolved solids comprising solid contaminants between a pair of porous endless belts to provide a composite structure, moving the composite structure through a treating zone and subjecting the mat while in said zone to alternate stages of compression and relaxation to thereby cause a liquid stream containing solid contaminants to impregnate said mat, maintaining the concentration of the dissolved solids in the liquid stream greater then the concentration of dissolved solids in said mat to thereby cause dissolved solids in the liquid stream to dissolve in the liquid phase of said mat and increase the concentration of dissolved solids in the mat and reduce the concentration of dissolved solids in said liquid stream, and removing liquid from the mat to produce a residue containing a high concentration of dissolved solids.

5. The method of claim 4, and including the step of withdrawing liquid from the mat when the mat is subjected to compression.

6. The method of claim 4, wherein said liquid is water.

7. A method of treating a liquid slurry, comprising the steps of positioning a thin mat of a liquid slurry containing suspended solid material comprising solid contaminants between a pair of porous endless belts to provide a composite structure, moving the composite structure through a zone containing a series of spaced rolls and passing the composite structure over the rolls in a generally sinuous path, directing a liquid stream containing a reactive substance capable of reacting with said solid material against the portion of the composite structure passing between adjacent rolls to thereby cause said liquid stream to impregnate the mat, reacting the reactive substance with the solid material of said mat, and removing liquid from the mat to produce a compacted mat.

8. A method of treating materials, comprising the steps of positioning a thin mat of a liquid slurry containing suspended material comprising solid contaminants between a pair of porous endless belts to provide a composite structure, moving the composite structure through a zone containing a series of spaced rolls and passing the composite structure over the rolls in a generally sinuous path such that a first belt of said pair is in directed contact with one of said rolls and a second belt of said pair is in direct contact with the next adjacent roll, directing a liquid stream containing suspended material comprising solid contaminants against the composite structure at locations between adjacent rolls to thereby trap suspended material of said liquid stream in the suspended material of said mat and thus produce a mat having an increased concentration of suspended material and a liquid stream having a reduced concentration of suspended material.

9. The method of claim 8, wherein the suspended material in said mat is cellulosic fibers and the suspended material in the liquid stream is starch.

* * * * *